US011511328B2

(12) United States Patent
Feldmann et al.

(10) Patent No.: US 11,511,328 B2
(45) Date of Patent: Nov. 29, 2022

(54) DYNAMIC ROLL GAP CONTROL DURING FLEXIBLE ROLLING OF METAL STRIPS

(71) Applicant: Muhr und Bender KG, Attendorn (DE)

(72) Inventors: Andre Feldmann, Olpe (DE); Christian Brüser, Olpe (DE); Alexander Eick, Plettenberg (DE)

(73) Assignee: Muhr und Bender KG, Attendorn (DE)

( * ) Notice: Subject to any disclaimer, the term of this patent is extended or adjusted under 35 U.S.C. 154(b) by 101 days.

(21) Appl. No.: 17/052,568

(22) PCT Filed: May 3, 2019

(86) PCT No.: PCT/EP2019/061410
§ 371 (c)(1),
(2) Date: Nov. 3, 2020

(87) PCT Pub. No.: WO2019/215045
PCT Pub. Date: Nov. 14, 2019

(65) Prior Publication Data

US 2021/0229150 A1 Jul. 29, 2021

(30) Foreign Application Priority Data

May 8, 2018 (EP) ..... 18171365

(51) Int. Cl.
*B21B 37/26* (2006.01)
*B21B 38/04* (2006.01)

(52) U.S. Cl.
CPC ..... *B21B 37/26* (2013.01); *B21B 38/04* (2013.01); *B21B 2261/043* (2013.01)

(58) Field of Classification Search
CPC ..... B21B 37/16; B21B 37/24; B21B 37/26; B21B 37/58; B21B 38/04; B21B 2261/04;
(Continued)

(56) References Cited

U.S. PATENT DOCUMENTS 3,635,059 A * 1/1972 Smith, Jr. ..... B21B 37/60 72/229
5,586,221 A 12/1996 Isik et al.
(Continued)

FOREIGN PATENT DOCUMENTS

AT 294255 B 11/1971
DE 3637043 A1 5/1988
(Continued)

OTHER PUBLICATIONS

Jan Lunze; "Regelungstechnik 2", 9. Auflage 2016, Springer Vieweg; pp. 423-438 (719 pages; with English machine translation of pp. 423-438).

(Continued)

*Primary Examiner* — Edward T Tolan
(74) *Attorney, Agent, or Firm* — Bejin Bieneman PLC

(57) ABSTRACT

A method for dynamic roll gap control for flexible rolling of metallic strip material can include: defining a nominal thickness profile with defined nominal corner points and with profile sections lying in between, wherein two profile sections adjoining a nominal corner point each have different average gradients; flexible rolling of the strip material according to the nominal thickness profile; measuring an actual thickness profile of the flexibly rolled strip material; determining actual corner points corresponding to the nominal corner points and actual intermediate points corresponding to the nominal intermediate points; determining corner point comparison values from the nominal corner points and the corresponding actual corner points, as well as intermediate point comparison values from the nominal intermediate points with the corresponding actual intermediate points; controlling a roll gap depending on the corner point comparison values and the intermediate point comparison values.

15 Claims, 4 Drawing Sheets

(58) Field of Classification Search
CPC ..... B21B 2261/043; B21B 2261/05; B21B 2205/02
See application file for complete search history.

(56) References Cited

U.S. PATENT DOCUMENTS

| | | | | |
|---|---|---|---|---|
| 7,185,520 | B2 * | 3/2007 | Pampel | B21B 37/18 72/11.8 |
| 7,354,492 | B2 | 4/2008 | Rashnikov et al. | |
| 8,356,504 | B2 * | 1/2013 | Koh | B21B 37/26 72/240 |
| 2006/0033347 | A1 | 2/2006 | Hauger et al. | |
| 2010/0095722 | A1 * | 4/2010 | Nishiura | B21B 1/26 72/12.2 |
| 2021/0178443 | A1 * | 6/2021 | Frenzel | G05B 19/41815 |

FOREIGN PATENT DOCUMENTS

| | | | | |
|---|---|---|---|---|
| DE | 3807399 | C3 | 9/1989 | |
| DE | 10 2012 200936 | A1 | 7/2013 | |
| EP | 1074317 | B1 | 2/2001 | |
| JP | S56114511 | A | 9/1981 | |
| JP | H04-13409 | A | 1/1992 | |
| JP | 2000-061518 | A | 2/2000 | |
| JP | 3389903 | A | 3/2003 | |
| RU | 2177847 | C1 | 1/2002 | |
| RU | 2494826 | C1 | 10/2013 | |
| WO | 2007104616 | A1 | 9/2007 | |
| WO | 2014/016120 | A1 * | 1/2014 | B21B 37/26 |

OTHER PUBLICATIONS

Hasenjager; "Regelungstechnik fur Dummies", Auflage 2015; Wiley-VCH Verlag GmbH & Co. KGaA, Weinheim; ISBN: 978-3-527-70893-2 (6 pages; with English machine translation).

Notice of Opposition mailed Oct. 6, 2021 for Application No. EP3566790 (31 pages).

Nov. 9, 2021 English Summary of Notice of Opposition mailed Oct. 6, 2021 for Application No. EP3566790 (3 pages).

Ping Du, Strategy of Longitudinal Variable Thickness, Flat Products, Engineering Technology vol. I, Issue 6, 2011, pp. B022-B052, Jun. 15, 2011 (68 pages; English translation of selected pages provided).

Zhiqiang Wu, Research and Development of Rolling, Control System for Periodic Variable Thickness Strip, Engineering Technology vol. I, Issue 7, 2015, pp. B022-B161, Jul. 15, 2015 (83 pages; English translation of selected pages provided).

International Search Report and Written Opinion for PCT/EP2019-061410 dated Jun. 17, 2019 (10 pages; with English translation).

Schwarz N et al. "Flexibel Gewalzte Blech Feur Belastungsangepasste Werkstuecke" Werkstatt + Betrieb, Carl Hanser Verlag, München DE, vol. 131, No. 5, May 1, 1998 (May 1, 1998), pp. 424-427; ISSN: 0043-2792, XP000776752; Figure 1 (English translation not available).

Hauger, Andreas Flexibles Walzen als kontinuierlicher Fertigungsprozess Feur Tailor Rolled Blanks. Shaker, 1999 (72 pages; with English machine translation).

* cited by examiner

DYNAMIC ROLL GAP CONTROL DURING FLEXIBLE ROLLING OF METAL STRIPS

CROSS-REFERENCE TO RELATED APPLICATIONS

This application is a national stage of, and claims priority to, Patent Cooperation Treaty Application No. PCT/EP2019/061410, filed on May 3, 2019, which application claims priority to European Union Application No. EP 18171365.2, filed on May 8, 2018, which applications are hereby incorporated herein by reference in their entireties.

BACKGROUND

From the dissertation "Hauger, Andreas. Flexible rolling as a continuous manufacturing process for Tailor Rolled Blanks. Shaker, 1999", a method for dynamic roll gap control is known that provides for an iterative optimization of the roller setting data. A recurring nominal thickness profile for a strip material is described by characteristic nominal corner points. For linear profiles consisting of plateaus and ramps with a constant gradient, these nominal corner points are defined by the intersections of plateaus and ramps. In the case of a non-linear profile, the nominal corner points are defined by the local minima and maxima of the profile and the profile is subjected to a fictional linearization. The actual thickness profile of a section of strip material to be optimized, rolled by means of first roller setting data, is measured behind the roll gap and is also assigned characteristic actual corner points by automated profile recognition. Corrected roller setting data are determined from the deviations between the nominal corner points and actual corner points and fed to the rolling process of a further strip section.

From the US2006/0033347 A1, thickness profiles for strip material, which is used as raw material for various structural components in automotive applications, are known. The thickness profiles comprise different regions with constant thickness, which are connected by regions with variable thickness and constant gradient.

The requirements of customers for flexible rolled strip material, for example in terms of dimensional accuracy and costs, are constantly increasing. There is a need to provide a method of a dynamic roll gap control that achieves high dimensional accuracy of the rolled strip material at high rolling speeds and is cost-efficient.

SUMMARY

The present disclosure includes a method for dynamically controlling a roll gap of a rolling device for flexible rolling of metal strips. Flexible rolling involves rolling one or more sections with variable thickness profiles successively and, as the case may be, recurrently into a strip material.

A method for dynamically controlling the roll gap during flexible rolling of metallic strip material is disclosed, with the steps:

defining a nominal thickness profile with defined nominal corner points and profile sections lying between the nominal corner points, whereby two profile sections adjoining a nominal corner point each have different mean gradients; flexible rolling of the strip material according to the nominal thickness profile; measuring of an actual thickness profile of the flexible rolled strip material and determining of actual corner points corresponding to the nominal corner points; comparing of the nominal corner points with the corresponding actual corner points and determining corner point comparison values from the nominal corner points and the corresponding actual corner points; controlling of a roll gap depending on the corner point comparison values; wherein nominal intermediate points are defined on at least a partial number of the profile sections lying between nominal corner points, and wherein actual intermediate points corresponding to the nominal intermediate points are determined from the measured actual thickness profile; and wherein nominal intermediate points are compared with the corresponding actual intermediate points and intermediate point comparison values are determined, respectively, and wherein controlling of the roll gap is performed additionally depending on the intermediate point comparison values.

An advantage is that deviations of the actual thickness profile from the nominal thickness profile can be more accurately detected and corrected also between the corner points, whereby a stable control loop with good command behavior can be achieved. By defining the intermediate points, local deviations between the corner points are detectable. In addition, the process can still be operated in a stable manner by introducing intermediate points, whereas an evaluation of all measurement points of the actual profile would lead to a disproportionate increase in the required computing power and the process could become unstable.

The definition of a nominal thickness profile of strip material is derived from the requirements of the component to be produced from the strip material and is usually recurrently rolled into strip material several times. One nominal thickness profile can be rolled into the strip material recurrently in succession or a sequence of different nominal thickness profiles can be rolled into the strip material. The strip material is usually subsequently separated into blanks with the length of the nominal thickness profiles, from which the desired components can be produced by forming processes. The nominal thickness profile is defined in such way that digital processing is possible. For example, this can be done continuously by means of equations or by quasi-continuous, discrete value pairs of thickness value and longitudinal position value.

The nominal thickness profile comprises at least a first profile section and an adjacent second profile section with different mean gradients. In a possible embodiment, a first profile section can be defined as a plateau, with at least a substantially constant thickness, and a second profile section can be defined as a ramp. Ramps have a variable thickness profile and a course of gradient on at least one of the top and bottom sides of the strip. In another possible embodiment, the second profile section can have a constant gradient. This embodiment can also be described as a linear nominal thickness profile. In a further possible embodiment, the second profile section can have a variable gradient and/or can continuously merge into the first profile section. This embodiment can also be described as a non-linear nominal thickness profile.

The nominal thickness profile of the strip material is characterized by the nominal corner points, while the nominal intermediate points serve as additional support points for optimizing the roll gap control. The nominal corner points describe the transition points from a first section to a second section, e.g., the transition from a plateau to a ramp or the transition from a ramp with a first course of gradient to a ramp with a second course of gradient.

The nominal intermediate points are arranged on a profile section of the nominal thickness profile between two nominal corner points. In a possible embodiment, the distance between a nominal corner point and a nominal intermediate point as well as between two nominal intermediate points can be at least 5 mm in a longitudinal direction of the strip material. It has been shown that at high rolling speeds the distance between the characteristic points can be at least 5 mm in the longitudinal direction of the strip so that a stable control loop can be established. Rolling speeds that allow cost-effective series production of flexible rolled strip material are generally above 20 m/min, with rolling speeds depending on the complexity of the nominal thickness profile to be rolled. At distances smaller than 5 mm, the smallest measurement and profile deviations are fed back to the control circuit. Due to very large masses of several tons to be moved in the shortest times of less than 200 ms, this can cause the overall system to increasingly oscillate, which would lead to increased deviations between the nominal thickness profile and the actual thickness profile produced with the newly determined roller setting data. In the aforementioned embodiment with a minimum distance of 5 mm, intermediate points can therefore only be provided in sections with an extension in the longitudinal direction of at least 10 mm. The maximum number of intermediate points on a section of the nominal thickness profile is limited analogously by the extension of the section in the longitudinal direction and the minimum distance between two points.

In a further embodiment, the number of nominal intermediate points between two nominal corner points may be less than 20, e.g., less than 6, e.g., less than 3, to ensure efficient utilization of the computing power of the control system. This should also include the fact that individual profile sections of the nominal thickness profile have no intermediate points.

In a possible embodiment, the nominal intermediate points can be evenly distributed over at least a partial number of profile sections located between the nominal corner points, i.e. the distance between the corner points of the profile section and the adjacent intermediate points as well as between the intermediate points is the same. This has the advantage that the position of the intermediate points can be determined automatically by simply specifying the number of intermediate points per section.

In a possible embodiment, the nominal intermediate points can be distributed unevenly over at least a partial number of the profile sections lying between the nominal corner points. This has the advantage that profile ranges with a high process dynamic can experience a higher resolution than profile ranges with a lower process dynamic and the computing power of the control is used efficiently. For example, for longer plateau sections, the distance between the nominal corner points and the adjacent nominal intermediate points may correspond to the minimum distance to describe the transition area of two sections and the distance between the following nominal intermediate points may increase to the center of each section. This allows an optimized dimensional accuracy of the rolled strip material to be achieved in the high-resolution areas, while the reduction of the total number of characteristic points, on the other hand, saves computing power and higher rolling speeds can be achieved.

The determination of the first roller setting data to achieve the nominal thickness profile can be done, for example, by rolling a calibration profile on an initial section or on separate strip material, by process simulation as well as based on empirical values.

After rolling the strip material with the first roller setting data, comparison values between the nominal corner points respectively the nominal intermediate points and the actual corner points respectively the actual intermediate points are determined. In one possible embodiment, the actual thickness profile of the strip material after flexible rolling can be acquired by means of a contactless thickness measuring system on at least one measuring track in a longitudinal direction of the strip material and by means of at least one strip length measuring unit. The measured values are captured at discrete measuring points. The measuring points can be a few micrometers apart from each other in the longitudinal direction, so that the thickness profile is imaged quasi-continuously. In particular, the thickness measuring system and the strip length measuring unit can be integrated in a common system. Depending on the application, the measuring track in which the measurement of the thickness is performed can be arranged in the middle of the strip material or offset from it. It is also conceivable that the thickness measuring system measures the actual thickness profile in several measuring tracks. The strip thickness can be determined on up to 20 measuring tracks. The measuring tracks can be evenly spaced from each other. It is also conceivable that the distance of the measuring track is irregular and increases, for example, from the center towards the edge of the strip material. In a further embodiment, the at least one strip length measuring unit can generate trigger signals at equidistant intervals, which in each case initiate a measurement of at least one thickness value by the thickness measuring system. The thickness values determined in this way can subsequently be applied to a filter for floating mean value calculation in order to eliminate measurement outliers.

Contactless thickness measuring systems can measure the thickness of the strip material quasi-continuously, i.e. at discrete points which are separated by a few micrometers from each other, whereby a measuring spot is scanned around the respective measuring point. The measuring spot of a measuring method is the area on the surface of the object to be inspected which is taken into account for determining the measured value at a measuring point. The smaller the measuring spot, the higher is the resolution of the measuring method. In a possible embodiment, the measuring spot of the contactless thickness measuring system can be smaller than 10.0 mm, e.g., smaller than 1.0 mm, e.g., smaller than 0.1 mm, e.g., smaller than 0.06 mm. In particular, laser-based thickness measuring systems fulfill this requirement for the size of the measuring spot and can therefore be used in an embodiment of the method. Laser-based thickness measuring systems have a measuring spot extent that is approximately 10 times smaller than, for example, radiometric measuring methods. Smaller measuring errors achieved in this way, in combination with the intermediate points, allow higher rolling speeds to be achieved with high dimensional accuracy.

In a possible embodiment, the at least one strip length measuring unit can have an accuracy of at least 0.1% of the measured value, e.g., at least 0.05%. This has the advantage that the thickness measurement values can be assigned more exactly to the real longitudinal position and thus the determination of the actual corner points and the actual intermediate points in the longitudinal direction can be carried out with higher accuracy.

The determination of actual corner points and actual intermediate points on the basis of the measured actual thickness profile can be carried out using pattern recognition methods, e.g., profile recognition. There are a number of mathematical methods for this purpose, which will not be discussed further here. Instead, it is referred to Chapter 7 of the aforementioned dissertation Hauger as an example. The actual corner points determined in this way are compared with the corresponding nominal corner points and the actual intermediate points are compared with the corresponding nominal intermediate points, and corner point comparison values respectively the intermediate point comparison values are determined.

Controlling of the roll gap depends on the first roller setting data and the corner point comparison values respectively the intermediate point comparison values. For this purpose, the roller setting data can be recalculated depending on the first roller setting data and the corner point comparison values respectively the intermediate point comparison values, either by means of formulae or on the basis of empirical values from a database. In a possible embodiment, an incoming strip thickness can be measured in front of the roll gap and controlling of the roll gap can be performed additionally depending on the incoming strip thickness in front of the roll gap. In another embodiment, the roll gap can be controlled in range between a nominal corner point and an adjacent nominal intermediate point by interpolating respectively corresponding corner point comparison values and intermediate point comparison values, or in a range between two adjacent nominal corner points by interpolating respectively corresponding corner point comparison values, or in a range between two adjacent nominal intermediate points by interpolating respectively corresponding intermediate point comparison values.

Recalculated roller setting data can either be completely determined for one section and applied first at the beginning of the next recurring section. Or the recalculated roller setting data can be determined continuously and applied directly in the process. Depending on whether a nominal thickness profile is rolled into the strip material recurrently or a sequence of different nominal thickness profiles is rolled into the strip material, the delay time due to the distances between the thickness measuring system and the roll gap must be taken into account. The comparison and correction values determined for the described method can also be used to control other process parameters of flexible rolling, such as controlling of the strip tensions.

BRIEF DESCRIPTION OF THE DRAWINGS

In the following figures example embodiments are explained. Herein

DESCRIPTION WITH REFERENCE TO THE DRAWINGS

Figure 1:
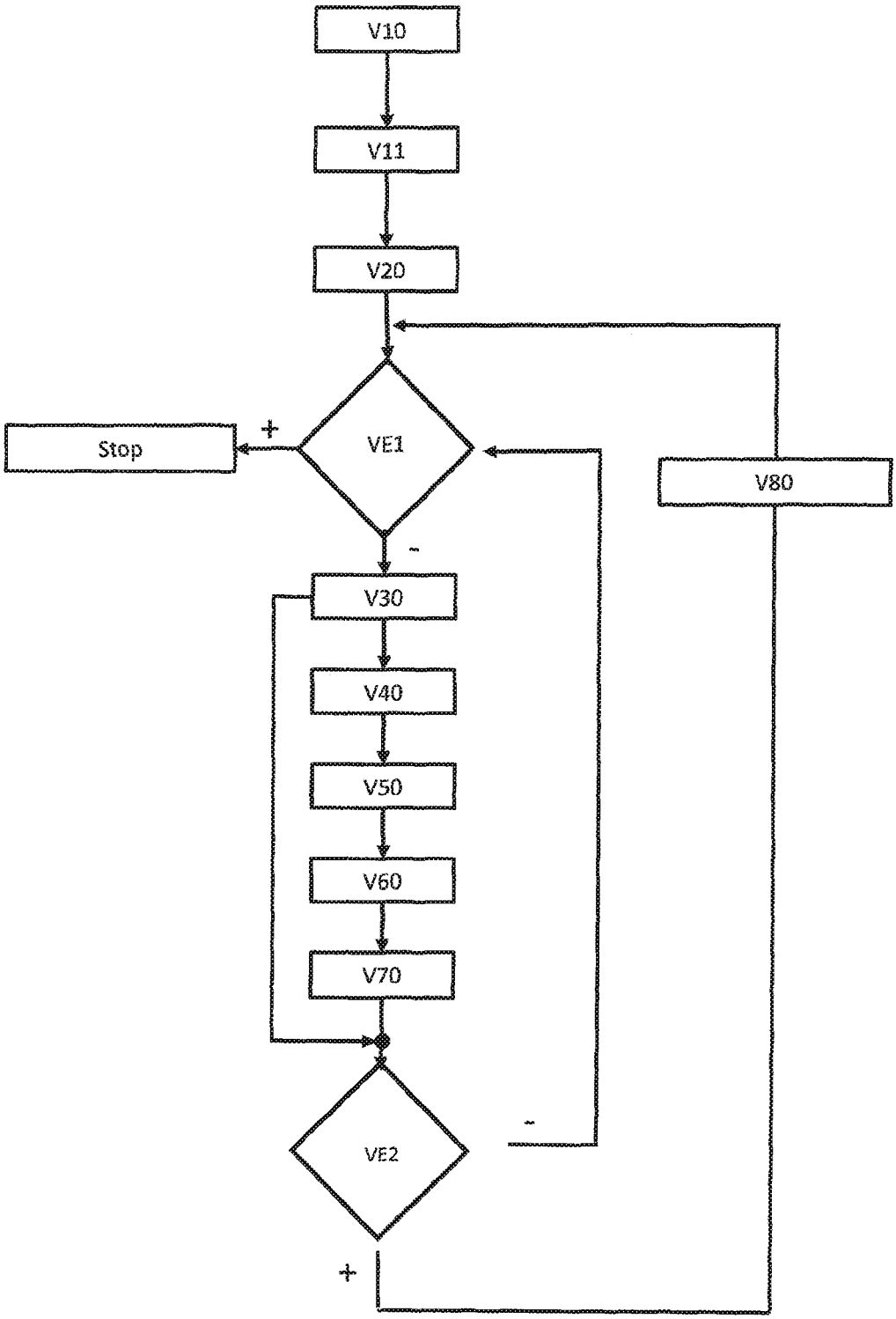
FIG. 1 is a flow diagram of an example method.

FIG. 1 shows a method of a roll gap control for flexible rolling of strip material 11 schematically on the basis of a flow diagram. FIG. 6 schematically shows a device for carrying out the method. The FIGS. 1 to 6 are described jointly in the following.

In a first process step V10, a nominal thickness profile 1 is defined. This is based on the requirements of the product for which the flexible rolled strip material 11' is to be used as starting material. The nominal thickness profile 1 can be obtained either in sections by means of formulae or by a matrix with discrete value pairs from the parameters thickness value D and longitudinal position value L. In particular, the nominal thickness profile 1 is defined in such way that it can be digitally processed. This can be done either in a separate computer unit 8, for example a CAD workstation, or directly in a process control unit 9.

A nominal thickness profile 1 comprises at least a first profile section 2', 2" and an adjacent second profile section 3', 3" which have different mean gradients. The mean gradient is defined by the connecting line between the corner points of a profile section. The first profile section 2', 2" is configured as a ramp with a variable thickness value D and the second profile section is configured as a plateau with a constant thickness value D. The ramps 2', 2" may be linear and have a constant gradient or non-linear and have a variable gradient.

Figure 2:
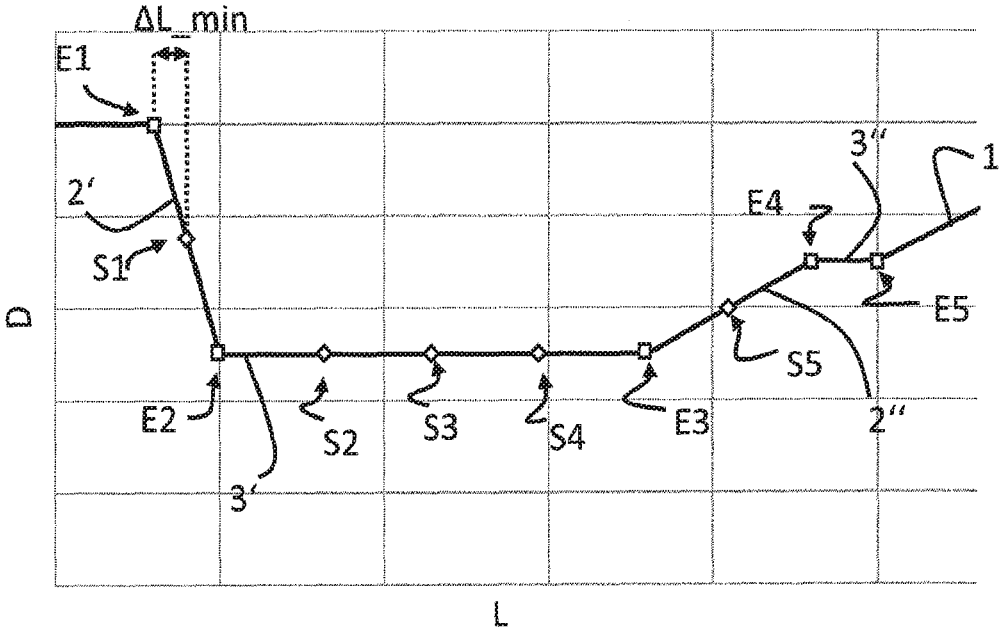
FIG. 2 shows a section of a nominal thickness profile for flexible rolled strip material with nominal corner points and nominal intermediate points.

The transition from a plateau section 3', 3" to a ramp section 2', 2" and vice versa is described by a nominal corner point E. The nominal corner points E characterize the nominal thickness profile 1. FIG. 2 shows an example of a section of a nominal thickness profile 1 with the corresponding corner points E1 to E5 (squares) for strip material 11' to be rolled flexibly. The first ramp 2' between corner points E1 and E2 has a negative gradient, so that there is a thickness reduction of the strip material 11' in this range. Then, a first plateau 3' follows between the corner points E2 and E3. A second ramp 2" with positive gradient and accompanying thickness increase is formed by the section between the corner points E3 and E4. The section of the nominal thickness profile 1 ends with a second plateau 3" between the corner points E4 and E5. The nominal thickness profile 1 was also assigned the nominal intermediate points S1 to S5 (diamonds). Nominal intermediate points S serve as support points for optimizing the roll gap control according to the nominal thickness profile 1. The first and second ramps 2', 2" are each assigned an intermediate point S1 respectively S5 in the middle. The nominal intermediate point S1 is exactly at a minimum distance ΔL_min from its associated nominal corner points E1 and E2. The minimum distance ΔL_min between a nominal corner point E and a nominal intermediate point S or two nominal intermediate points S leads to that the control of the roll gap can be carried out in a stable manner. Distances below the minimum distance ΔL_min can cause the control to increasingly oscillate and lead to significant deviations in the strip material 11' to be produced. For a rolling mill in accordance with the present disclosure, the minimum distance ΔL_min may be at least 5 mm. On profile sections which are smaller than twice the minimum distance ΔL_min, such as the second plateau 3", no nominal intermediate points S can be defined. The minimum distance ΔL_min assigns an upper limit for the number of nominal intermediate points S to a nominal thickness profile 1 with a given length. Thus, the computing power of the process control unit 9 required for the further process can be efficiently limited. In order to make efficient use of the available computing power of a process control unit 9 of an existing roll gap control, it is also conceivable that the number of nominal intermediate points S on the plateaus 3', 3" and ramps 2', 2" is limited to a maximum number in each case and in particular is less than 20.

The three intermediate points S2 to S4 are assigned evenly distributed to the first plateau 3'. Depending on the length of the section, it would also be conceivable that the intermediate points are distributed unevenly. For example, the nominal intermediate points S2 and S4 could each be positioned closer to the nearest nominal corner point E2 or E3 taking into account the minimum distance ΔL_min and the nominal intermediate point S3 could remain in the middle of the section. Thus, the transition area between the first ramp 2' and the first plateau 3' respectively the first plateau 3' and the second ramp 2" could be resolved more precisely with a constant number of nominal corner points E and nominal intermediate points S.

If the nominal thickness profile 1 is defined in a separate computer unit 8, the nominal thickness profile 1 is transferred to the process control unit 9 in a further process step V11. In process control unit 9, a first set of roller setting data is then determined from the nominal thickness profile 1 in process step V20. This can be done either on the basis of empirical values from databases or by simulation. It is also conceivable that the first roller setting data is determined in a separate computer unit 8 and the first roller setting data is transferred together with the nominal thickness profile 1 to the process control unit 9.

The process control unit 9 checks in step VE1 whether the end of the incoming strip material 11 has been reached. When the end of the incoming strip material 11 is reached, the process is interrupted. If the end of the incoming strip material 11 has not yet been reached, the thickness profile of the incoming strip material 11 can be measured in an optional process step V30. With the optional process step V30, a matrix is formed with the value pairs from the parameters thickness value D of the incoming strip material 11 and a longitudinal position value L, taking into account the distance Lv30 to the roll gap 12. The incoming strip material 11 usually has a constant nominal thickness value DN and the measured thickness value shows only minor deviations from the nominal thickness value DN. It is also conceivable, however, that strip material 11 is fed in with a variable thickness profile, for example if large thickness transitions with several rolling strokes are to be achieved. The thickness of the incoming strip material 11 can be measured by a combination of a thickness measuring system 6 and a length measuring unit 17. These can be designed analogously to the measuring systems 7, 18 of process step V50, so that reference is made here to the explanations for process step V50.

The incoming strip material 11 is rolled in a process step V40 according to the first roller setting data. For this purpose, the incoming strip material 11 is guided through a roll gap 12, which is formed between a first working roll 4' and a second working roll 4". In particular, a four-high rolling stand may be provided to realize small diameters of the working rolls 4', 4", wherein the working rolls 4', 4" each being supported by a support roll 5', 5". The roll gap 12 between the two working rolls 4', 4" is set by a setting device 13, which is only schematically shown in FIG. 6. The setting device 13 moves at least one of the two working rolls 4', 4" vertically into a nominal setting position. The actuation of the setting device 13 can be carried out hydraulically in particular and the nominal setting position can be controlled via valves. Alternatively, an electro-mechanical embodiment of the setting device 13 is also conceivable. The process control unit 9 feeds a controller with the roller setting data, which the controller converts into a command signal for the valves and feeds it to the valves. The controller can be hard-wired or simulated by the process control unit 9, whereby the command signal is fed to the valves via power electronics.

Figure 3:
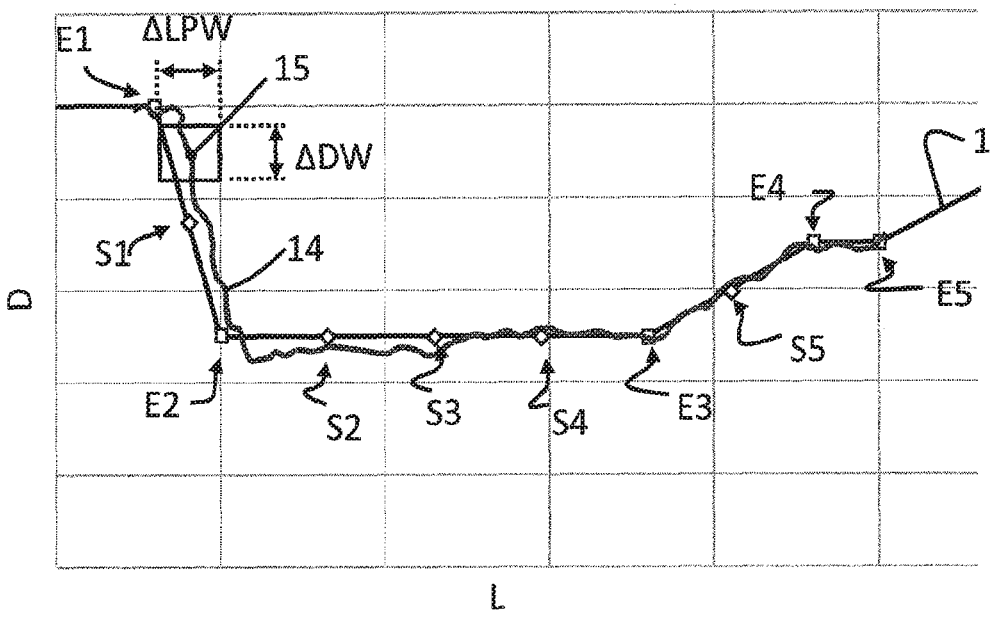
FIG. 3 shows a measured actual thickness profile in relation to the nominal thickness profile from FIG. 2.

After the incoming strip material 11 has been rolled, the resulting actual thickness profile 14 of the outgoing strip material 11' is measured behind the roll gap in a process step V50. Analogous to process step V30, a matrix is formed with the value pairs from the parameters strip thickness value D of the rolled strip material 11' and the corresponding longitudinal position value L, taking into account the distance Lv50 to the roll gap 12. FIG. 3 shows an actual thickness profile 14. The measuring can be done by a combination of a thickness measuring system 7 and a length measuring unit 18. In particular, a contactless, e.g. laser-based, thickness measuring system can be used as thickness measuring system 7. However, it is also conceivable to measure the thickness of the strip material 11' using tactile thickness measuring systems. The rolled strip material 11' is measured by the thickness measuring system 7 at measuring points that are only a few micrometers apart from each other, so that the actual thickness profile 14 is imaged quasi-continuously. A contactless, e.g., laser-based, measuring device can also be used as length measuring unit 18. Here, too, however, it is conceivable to use tactile measuring equipment. As shown in FIG. 3 for a discrete measuring point 15, the measurement inaccuracy for the position of a measuring point 15 is described by a surface determined by the measurement accuracy of the thickness measuring system ΔDW and the measurement accuracy of the length measuring device ΔLPW. In order to guarantee an exact recording of the position of the measuring point 15, an optimization of one of the two accuracies is therefore not sufficient and both accuracies ΔDW, ΔLPW must be optimized. The length measuring unit 18 can therefore have an accuracy ΔLPW of at least 0.1% of the measured value, e.g., at least 0.05%. The measuring spot 16 of the thickness measuring system 7 can also be smaller than 10.0 mm, especially smaller than 1.0 mm, especially smaller than 0.1 mm, especially smaller than 0.06 mm.

Figure 7:
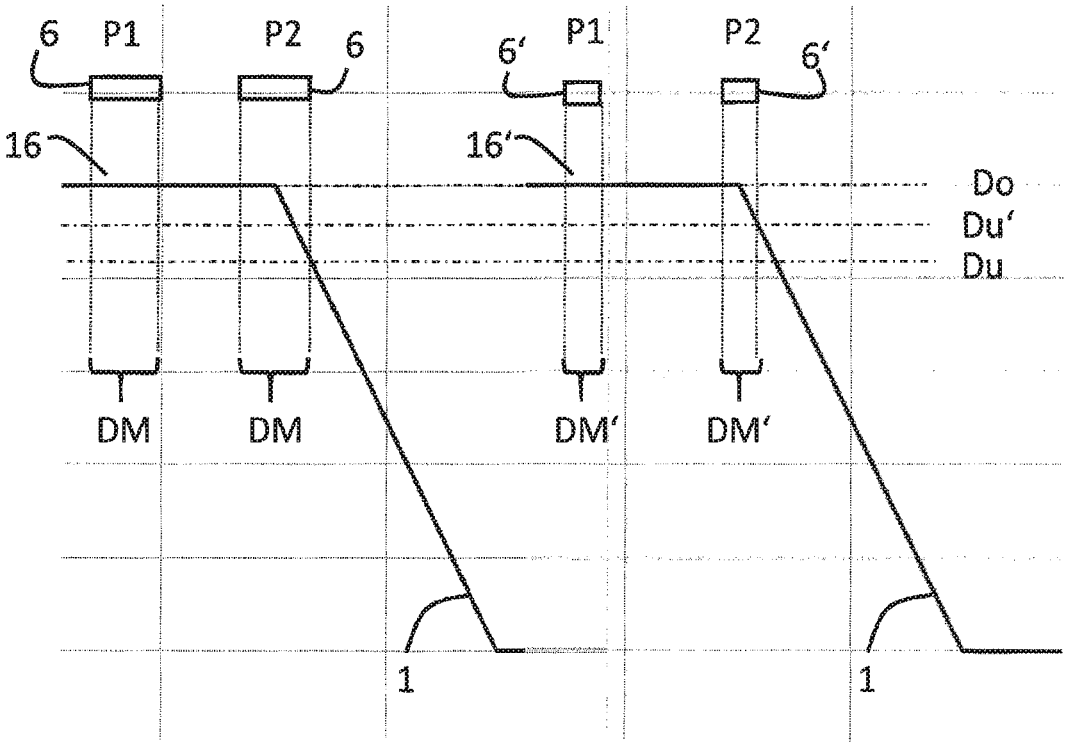
FIG. 7 schematically shows the measuring device of process step V50 of the method from FIG. 1.

FIG. 7 schematically shows the resulting advantages of a measuring spot 16, 16' as small as possible. On the left side of the figure, a first thickness measuring system 6 with a measuring spot extension DM is shown that scans a nominal thickness profile 1 with a plateau section and a ramp at two different measuring positions P1 and P2. At the measuring position P1, the measuring spot 16 is located solely on the plateau section of the nominal thickness profile 1 and only records thickness values Do, which also correspond to the nominal thickness values of the plateau. At measuring position P2, measuring spot 16 is located exactly at a nominal corner point. Due to the extension of the measuring spot 16, one half of the measuring spot 16 scans the plateau section with thickness values Do and the other half scans the ramp with thickness values between Do and Du. With linear averaging of the thickness values recorded by the measuring spot, a measured thickness value results between the values Do and Du. Since the thickness value of the nominal corner point is exactly Do, there is a first measurement deviation due to the expansion of the measuring spot 16.

On the right side of the figure a second thickness measuring system 6' with a measuring spot extension DM' is shown, which scans the nominal thickness profile 1 at the same measuring positions P1 and P2 as before. At the measuring position P1, the measuring spot 16' is located solely on the plateau section of the nominal thickness profile 1 and only records thickness values Do, which also correspond to the nominal thickness values of the plateau. At measuring position P2, the measuring spot 16' is exactly at a nominal corner point. Due to the extension of the measuring spot 16' one half of the measuring spot 16' scans the plateau section with thickness values Do and the other half scans the ramp with thickness values between Do and Du'. With linear averaging of the thickness values recorded by the measuring spot 16', a measured thickness value results between the values Do and Du'. Since the thickness value of the nominal corner point is exactly Do, a second measurement deviation results due to the expansion of the measuring spot 16', whereby the second measurement deviation of the second thickness measuring system 6' is smaller than the first measurement deviation of the first thickness measuring system 6. In this comparison it becomes clear that the advantage of thickness measuring systems with small measuring spot extension DM lies in the detection of measuring points whose adjacent areas have a different gradient. These are in particular corner points and intermediate points on non-linear ramps. Laser-based thickness measuring systems are therefore suitable, as their measuring spot 16', 16" has an extension DM that is approximately 10 times smaller than, for example, radiometric measuring methods.

Figure 4:
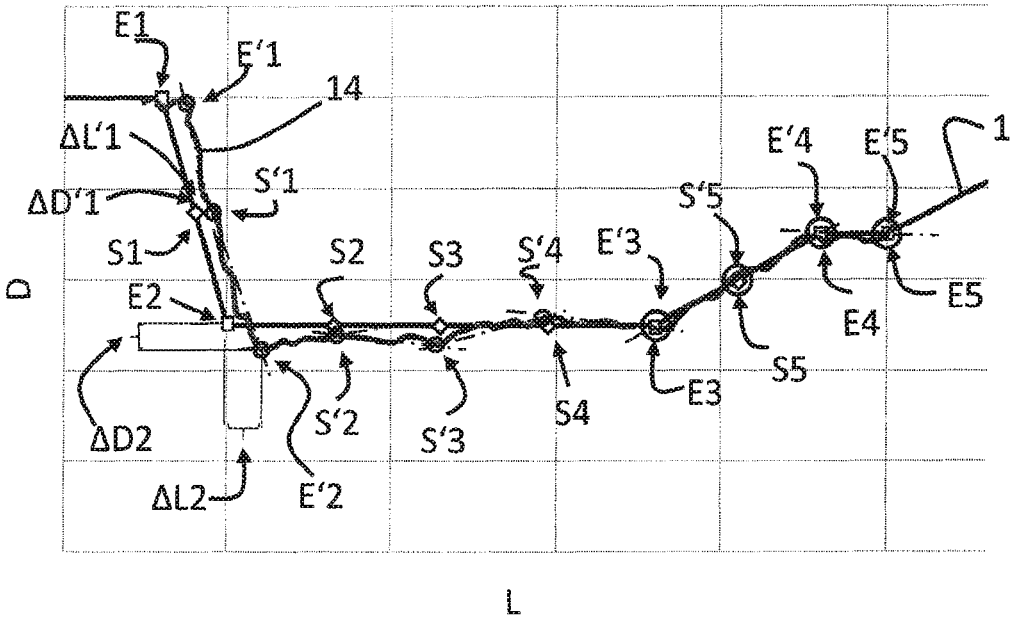
FIG. 4 shows the actual thickness profile from FIG. 3 after determining actual corner points and actual intermediate points and the resulting deviations from the nominal thickness profile.

The actual thickness profile 14 recorded by process step V50 is subjected to a further process step V60, in which actual corner points E' and actual intermediate points S' are derived from the actual thickness profile 14 using pattern recognition methods and are assigned to the corresponding actual corner points E and actual intermediate points S. FIG. 4 shows the actual corner points E' and actual intermediate points S' resulting from process step V60 for the actual thickness profile 14 from FIG. 3 as circles. Pattern recognition methods can be based on linear regression, fuzzy logic, and deviation optimization, for example. Depending on the pattern recognition method used, the introduction of boundary conditions may become necessary, for example the definition of a minimum and a maximum gradient.

In a further process step V70, the value pairs of thickness value D and longitudinal position value L of the nominal corner points E and nominal intermediate points S are compared with those of the corresponding actual corner points E' and actual intermediate points S' and, if necessary, the comparison values or deviations of the respective value pairs in the direction of the longitudinal position ΔL and in the direction of the thickness ΔD are determined. FIG. 4 shows an example of this using the nominal corner point E2 respectively the actual corner point E'2. The nominal corner point E2 and the actual corner point E'2 have the distance ΔL2 in the direction of the longitudinal position and the distance ΔD2 in the thickness direction. For all other characteristic points, analogue procedure is used, like sketched for deviations ΔL'1 and ΔD'1.

Figure 5:
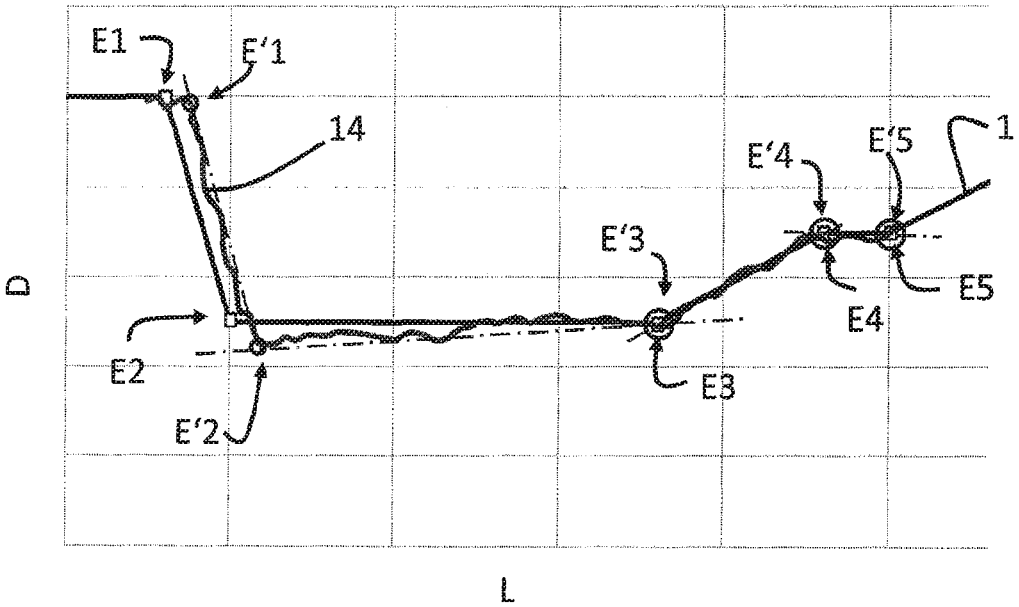
FIG. 5 shows the actual thickness profile from FIG. 3 after the determination of actual corner points and the resulting deviations from the nominal thickness profile without intermediate point consideration.
Figure 6:
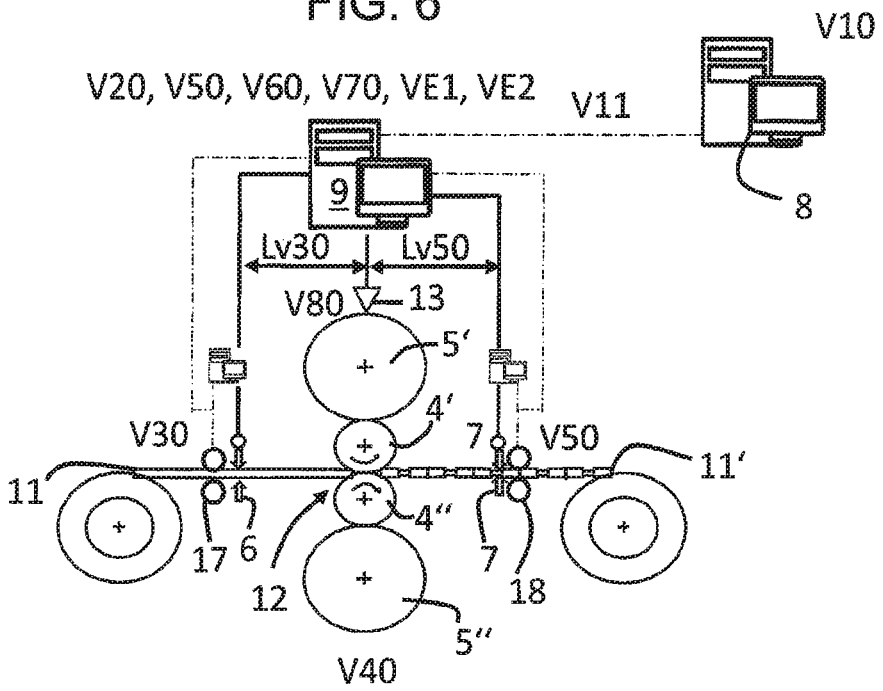
FIG. 6 schematically shows a device for carrying out the method of FIG. 1.

FIG. 5 shows the nominal thickness profile 1 from FIG. 1 and the actual thickness profile 14 from FIG. 3, whereby the intermediate points S, S' were not taken into account. A comparison with FIG. 4 clearly shows the advantage of the presently disclosed method. In the areas S1/S'1, S2/S'2 and S3/S3', the deviations of the actual thickness profile 14 from the nominal thickness profile 1 could be determined much more precisely using the inventive method, while at the same time making efficient use of the process computer power.

A second process decision VE2 can then be provided in the method, in which the comparison values determined are used to check whether the roller setting data should be corrected. During this check, the deviations of the incoming strip material 11 from the nominal thickness value DN determined in process step V30 can also be taken into account. For this purpose, a threshold value can be defined for the comparison values of the thickness value ΔD, ΔD' and the length position value ΔL, ΔL'. If the comparison values ΔD, ΔD' or the comparison values ΔL, ΔL' are below the threshold value, the roller setting data for the respective point will not be changed. If the threshold value is exceeded, the roller setting data is recalculated on the basis of the deviations determined in process step V70. The deviations of the incoming strip material 11 determined in process step V30 can also be taken into account for the recalculation of the roller setting data. The recalculation of the roller setting data can be done using experience-based correction factors or simulated in the process control unit 9.

In a first embodiment of the method, the roller setting data can be recalculated after complete determination of the comparison values ΔD, ΔD', ΔL, ΔL' for a profile section and can be used, after finalizing the recalculation, at the beginning of the next identical profile section for the control of the roll gap. Alternatively, it is also conceivable that the comparison values ΔD, ΔD', ΔL, ΔL' are determined point by point and the roller setting data are recalculated point by point. The recalculated roller setting data can then immediately be used for the current rolling process of the profile section to be rolled. The process is carried out iteratively until the process decision VE1 leads to a stop of the rolling process due to reaching the end of the incoming strip material 11.

LIST OF REFERENCE NUMBERS

1 nominal thickness profile
2', 2" ramp
3', 3" plateau
4', 4" working roller
5', 5" support roll
6 thickness measuring system
7 thickness measuring system
8 computer unit
9 process control unit
11; 11' strip material
12 roll gap
13 setting device
14 actual thickness profile
15 measuring point
16', 16" measuring spot
17 strip length measuring unit
18 strip length measuring unit
D thickness value
DM measurement spot extension
DN nominal thickness value
Do upper nominal thickness value
Du', Du'" lower nominal thickness value
E nominal corner point
E' actual corner point
L longitudinal position value
Lv30 distance measuring system 6 to roll gap
P measuring position
Lv50 distance measuring system 7 to roll gap
S nominal intermediate point
S' actual intermediate point
ΔL_min minimum distance
ΔLPW measuring accuracy length position value
ΔDW measuring accuracy thickness value
ΔD, ΔD' deviation in thickness direction
ΔL, ΔL' deviation in longitudinal direction

The invention claimed is:

1. A method for dynamically controlling a roll gap during flexible rolling of metallic strip material with the steps:

defining a nominal thickness profile with defined nominal corner points and profile sections lying between the nominal corner points, wherein nominal intermediate points are defined on at least a partial number of the profile sections lying between the nominal corner points, and wherein respective two profile sections adjoining a nominal corner point have different mean gradients;

flexible rolling the strip material so as to produce a plurality of recurring strip portions according to the nominal thickness profile;

measuring an actual thickness profile of one of the recurring strip portions of the flexible rolled strip material and determining actual corner points corresponding to the nominal corner points, and determining actual intermediate points corresponding to the nominal intermediate points;

comparing the nominal corner points with the corresponding actual corner points and determining respective corner point comparison values from the nominal corner points and the corresponding actual corner points;

comparing the nominal intermediate points with the corresponding actual intermediate points and determining respective intermediate point comparison values from the nominal intermediate points and the corresponding actual intermediate points; and controlling the roll gap during flexible rolling of another one of the recurring strip portions depending on the corner point comparison values and the intermediate point comparison values of the one of the recurring strip portions.

2. The method according to claim 1, wherein the actual thickness profile of the strip material is measured after the flexible rolling by a non-tactile thickness measuring system, on at least one measuring track in a longitudinal direction of the strip material, and by at least one strip length measuring unit.

3. The method according to claim 2, wherein the at least one strip length measuring unit generates trigger signals at equidistant intervals, wherein each respective trigger signal initiates a measurement of at least one thickness value by the thickness measuring system.

4. The method according to claim 2, wherein a measuring spot of the non-tactile thickness measuring system is smaller than 10.0 millimeters (mm).

5. The method according to claim 2, wherein the at least one strip length measuring unit has an accuracy of at least 0.1%.

6. The method according to claim 1, wherein a distance between a nominal corner point and a nominal intermediate point, as well as between two nominal intermediate points, is at least 5 mm in the longitudinal direction of the strip material.

7. The method according to claim 1, wherein an incoming strip thickness is measured in front of the roll gap, and wherein the controlling of the roll gap further depends on the incoming strip thickness in front of the roll gap.

8. The method according to claim 1, wherein controlling of the roll gap is performed in a region between a nominal corner point and an adjacent nominal intermediate point by interpolating the respective corresponding corner point comparison values and intermediate point comparison values, or in a region between two adjacent nominal corner points by interpolating the respective corresponding corner point comparison values, or in a region between two adjacent nominal intermediate points by interpolating the respective corresponding intermediate point comparison values.

9. The method according to claim 1, wherein a number of nominal intermediate points between two nominal corner points is less than 20.

10. The method according to claim 1, wherein a first profile section is defined as a plateau with at least substantially constant thickness, and a second profile section is defined as a ramp with a variable thickness.

11. The method according to claim 10, wherein the second profile section has a constant gradient.

12. The method according to claim 10, wherein the second profile section has a variable gradient and merges continuously into the first profile section.

13. The method according to claim 1, wherein on at least a partial number of the profile sections lying between the nominal corner points, the nominal intermediate points are evenly distributed.

14. The method according to claim 1, wherein on at least a partial number of the profile sections lying between the nominal corner points, the nominal intermediate points are distributed unevenly.

15. The method according to claim 2, wherein a measuring spot of the non-tactile thickness measuring system is smaller than 1.0 millimeters (mm), and wherein the at least one strip length measuring unit has an accuracy defined by a difference between a value measured by the length measuring unit and a true value intended to be measured of less than 0.1%, and wherein the flexible rolling of the strip material to produce the plurality of recurring strip portions according to the nominal thickness profile is carried out at rolling speeds of more than 20 m/min.

* * * * *